US006532889B1

(12) United States Patent
Goad et al.

(10) Patent No.: US 6,532,889 B1
(45) Date of Patent: Mar. 18, 2003

(54) ALUMINUM FISHING BOAT

(75) Inventors: Robert C. Goad, Springfield, MO (US); Marc E. Straub, Springfield, MO (US); Mike R. Terrell, Bolivar, MO (US); Tommy Morphis, Springfield, MO (US)

(73) Assignee: Tracker Marine, L.L.P., Springfield, MO (US)

( * ) Notice: Subject to any disclaimer, the term of this patent is extended or adjusted under 35 U.S.C. 154(b) by 0 days.

(21) Appl. No.: 09/615,615

(22) Filed: Jul. 14, 2000

(51) Int. Cl.[7] ..... B63B 3/00
(52) U.S. Cl. ..... 114/356
(58) Field of Search ..... 114/355–359, 65 R, 114/385, 386, 271

(56) References Cited

U.S. PATENT DOCUMENTS 1,915,160 A * 6/1933 Gray ..... 114/356
3,435,470 A * 4/1969 Krenzler ..... 114/357
3,628,487 A * 12/1971 Bennett ..... 114/285
3,848,284 A 11/1974 Livingston ..... 9/6
4,214,332 A * 7/1980 Stoner ..... 114/356
4,850,297 A * 7/1989 Rogstad ..... 114/356
4,896,622 A * 1/1990 Thomas ..... 114/285
5,036,790 A 8/1991 Berryer ..... 114/358
5,390,624 A 2/1995 Barnes ..... 114/288
6,145,466 A * 11/2000 Herbein et al. ..... 114/356

* cited by examiner

*Primary Examiner*—Ed Swinehart
(74) *Attorney, Agent, or Firm*—Shook, Hardy & Bacon LLP

(57) ABSTRACT

An aluminum boat is provided having a stringer assembly with curved stringer to support the boat. The boat further includes a keel box for encapsulation of foam at high pressure to strengthen the boat. An integral trim tab is provided to control the shingle angle of the boat. Also, a multi-piece knee brace assembly is provided to support the transom of the boat.

21 Claims, 4 Drawing Sheets

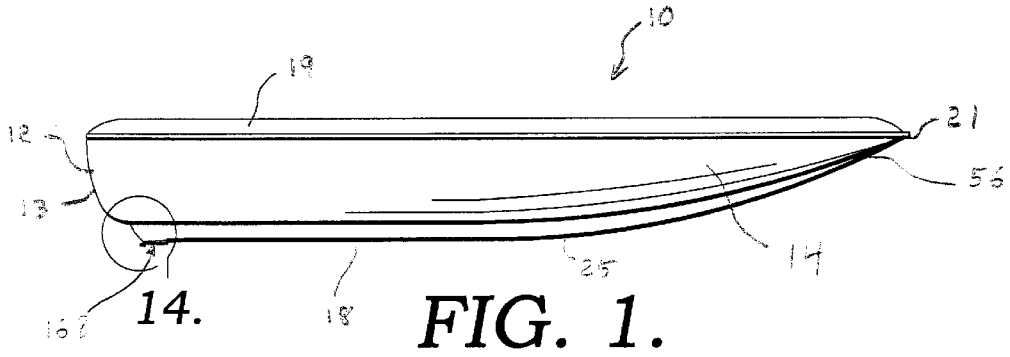
FIG. 1.
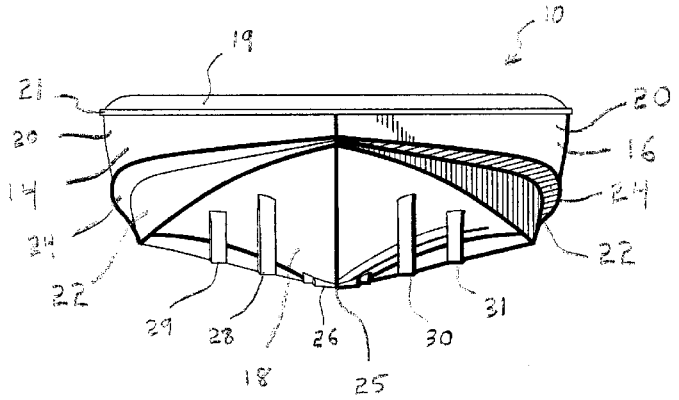
FIG. 2.
FIG. 3.
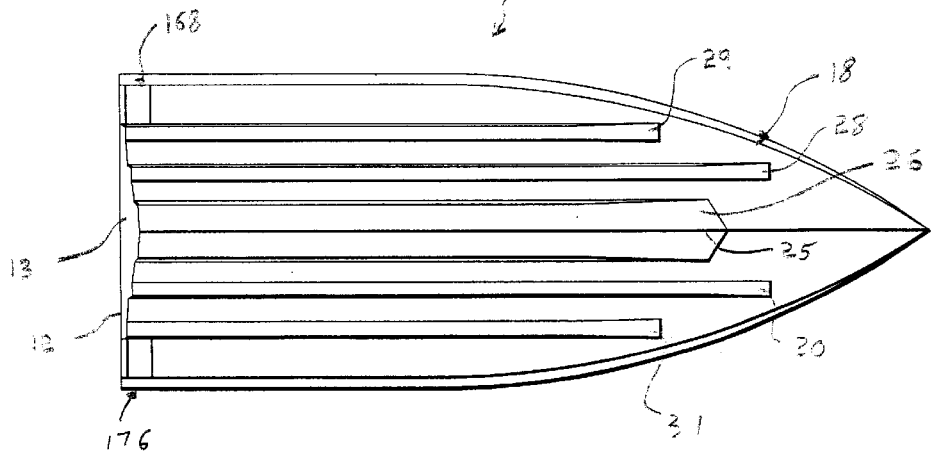

ALUMINUM FISHING BOAT

CROSS-REFERENCE TO RELATED APPLICATIONS

"Not Applicable"

STATEMENT REGARDING FEDERALLY SPONSORED RESEARCH OR DEVELOPMENT

"Not Applicable"

BACKGROUND OF THE INVENTION

The present invention relates to fishing boat and more particularly to a fishing boat having an aluminum construction and internal framework capable of high performance operation.

Fishing boats are typically used to provide anglers with the best opportunity to catch fish. In the past, simple fishing boat hulls have been constructed from rudimentary aluminum components. While these boats are relatively inexpensive, the boats are incapable of the high performance maneuvering that is desired by serious recreational anglers and competitive fishermen.

Boats made from fiberglass having more complex hulls and structural assemblies have been built to achieve higher performance standards. Specifically, these boats have contoured bottoms allowing for controlled maneuvering at higher speeds. A series of frame members known as stringer assemblies are utilized to prevent the boat from overflexing or otherwise improperly distributing the forces created at high speeds.

While fiberglass boats are capable of high performance, a number of drawbacks are present. For instance, fiberglass is relatively heavy. Thus, a larger motor is required to power the boat. The added weight of the boat hull and motor requires a more powerful vehicle to tow the boat. In a different vein, fiberglass hulls typically include a number of imperfections that result in cracking when the boats are operate under conditions requiring high performance. Additionally, the raw materials and production costs associated with fiberglass boats is significantly greater than with aluminum boats. For these reasons, an aluminum boat capable of high performance is needed.

BRIEF SUMMARY OF THE INVENTION

It is an object of the present invention to provide a boat with a stringer assembly having curved members to prevent flexure of the boat.

A further object of the present invention is to provide an aluminum boat having an integral trim tab to control the shingle angle of the boat at the stem.

Still another object of the present invention is to provide a boat having a keel plate encapsulating high pressure foam that supports the boat and aids in flotation.

Another object of the present invention is to provide a multi-piece knee brace assembly to support the transom of the boat when stressed by the weight of the boat motor and forces created at the stem of the boat.

Another object is to provide an aluminum boat with a bottom having a complex shape capable of high performance operation.

In accordance with the foregoing and other objects evident from the following description of a preferred embodiment of the invention, a boat having a stem, bow, port, starboard and keel is provided having a first beam, a stringer assembly, a transom frame assembly and a first knee brace assembly. The first beam extends laterally from port to starboard. The stringer assembly has a number of longitudinal members and a stringer knee brace beam. The stringer knee brace beam also extends laterally from port to starboard and is disposed between the first beam and the keel. The first knee brace assembly has a first diagonal beam, a first top beam, and a first vertical beam. The first diagonal beam is secured at one end to the stringer knee brace beam and is secured to the transom frame assembly at the other end. The first top beam is secured to the transom frame assembly near the first end of the first diagonal beam and is secured to the first beam at the other end. The first vertical beam is secured to the first beam near the first diagonal beam at one end and is secured to the stringer knee brace near the first diagonal beam.

In another aspect, a boat having a hull, a keel plate, and a foam material is provided. The hull has a keel surface having a bottom and a pair of opposing sidewalls. The keel plate is coupled between the sidewalls of the keel surface to define a cavity between the keel surface and the keel plate. A foam material is placed within the cavity to provide support to the hull.

In yet another aspect, a boat is provided having a hull and a stringer assembly. The hull has outwardly curved sidewalls. The stringer assembly has a number of lateral members and a number of curved stringers. The curved stringers have a shape generally corresponding to the curvature of the starboard and port sidewalls.

In another aspect, a boat is provided having a bottom and an integral trim tab. The bottom has opposing sides. Each side has a generally planar section proximate the stem on either side. The trim tab has a base member, a bend and a flange. The base member has a lead edge, a rear edge and a top surface. The bend extends generally normally from the rear edge of the base member and the flange extends from the bend at a predetermined angle with respect to the bottom of the boat when the top surface of the base member is secured to one of the sides of the bottom.

In yet another aspect, a boat is provided having an aluminum hull. The hull has an aluminum bottom. The aluminum bottom has a number of strakes. The stakes have at least one substantially curved surface.

By providing an aluminum boat in accordance with the present invention, numerous advantages are achieved. For example, a lightweight boat is provided that requires a smaller motor than a similar fiberglass boat. Similarly, a vehicle having less power is required to tow the boat. Moreover, the aluminum boat is capable of high performance because of the design of the hull and the structural integrity provided by the stringer assembly, transom frame and keel box of the present invention. The integral trim tabs of the present invention direct the water at the rear of the boat so that the boat is particularly adept at high speed maneuvering. Also, the aluminum boat is cheaper to build and less susceptible to cracks and other imperfections than fiberglass boats.

BRIEF DESCRIPTION OF THE SEVERAL VIEWS OF THE DRAWING

The objects and features of the invention noted above are explained in more detail with reference to the preferred embodiment illustrated in the attached drawing figures, in which like reference numerals denote like elements, and in which:

FIG. 1 is an side elevational view of a boat made in accordance with the present invention;

FIG. 2 is a front elevational view of the boat of FIG. 1;

FIG. 3 is a bottom plan view of the boat of FIG. 1;

DETAILED DESCRIPTION OF THE INVENTION

Figure 4:
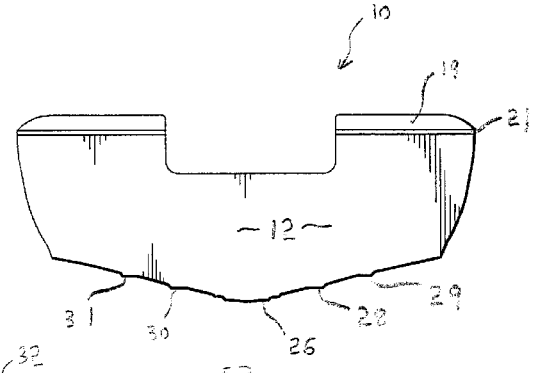
FIG. 4 is a rear elevational view of the boat of FIG. 1.

Referring to the drawing figures in greater detail, a boat 10 is shown in FIGS. 1–5. The boat 10 includes a transom 12 at the stern 13, a pair of symmetrical hull sidewalls 14 and 16 on the starboard and port sides of the boat, respectively, and a bottom 18. The components of the hull are preferably made from a lightweight aluminum. Most preferably, the hull 10 is made from a 5052 aluminum alloy or another corrosion resistant alloy suitable for marine embodiments.

The sidewalls 14 and 16 have a first bowed portion 20, a second bowed portion 22 and a sharply tapered portion 24 therebetween, as is known in the art for fiberglass boats. A gunnel 19 and rub rail 21 are formed about the top of the sidewall surfaces.

The design of bottom 18 is also known in the fiberglass boat industry. Specifically, the bottom includes a keel surface 26 about the keel 25, a main starboard chine 28, a main port chine 30 and opposing secondary chines 29 and 31 on the starboard and port sides, respectively. The chines closely mimic the shapes of the chines on fiberglass boats and have relatively complex configurations characterized by substantially curved surfaces with cross sectional profiles that are half elliptical, half circular or the shape of any of a number of partial conical half sections. The bottom 18 is formed to the complex shape by a stretch drawing process.

Figure 5:
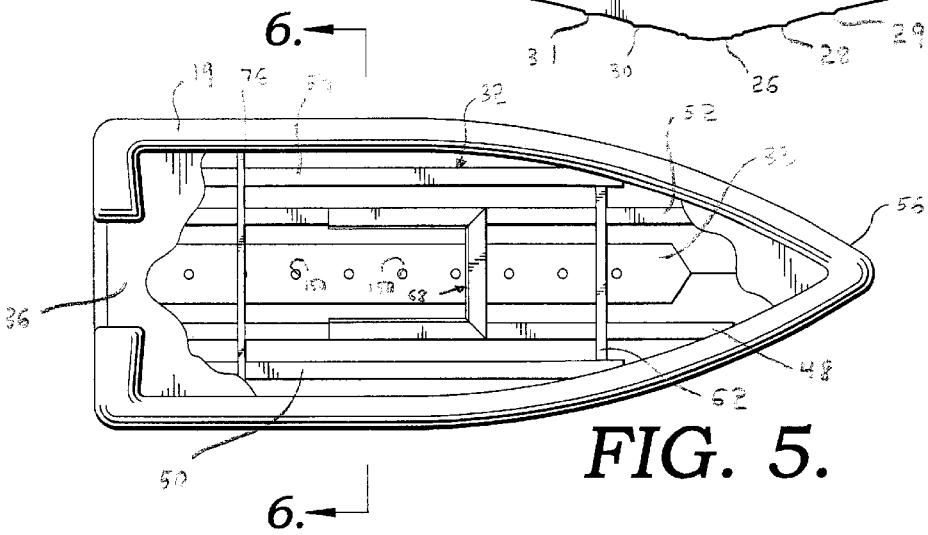
FIG. 5 is a fragmentary top plan view of the boat of FIG. 1 with the fuel tank removed to better illustrate the keel plate of the present invention.
Figure 6:
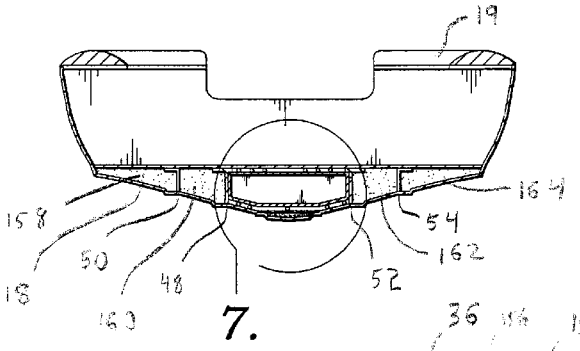
FIG. 6 is a sectional view taken along lines 6—6 of FIG. 5.
Figure 8:
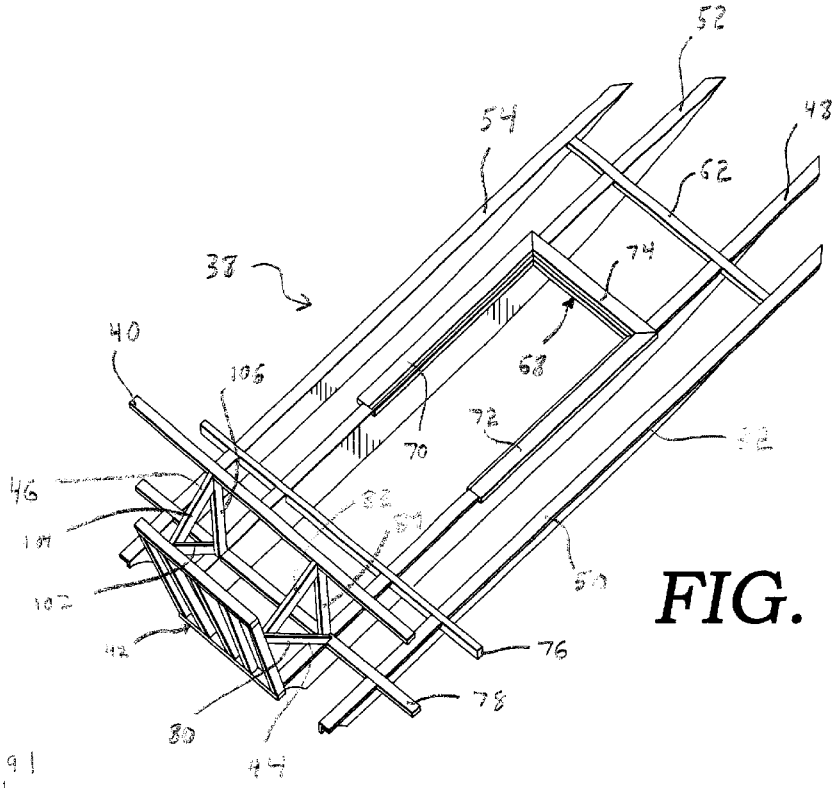
FIG. 8 is an perspective view of the internal framework of the boat of the present invention.
Figure 9:
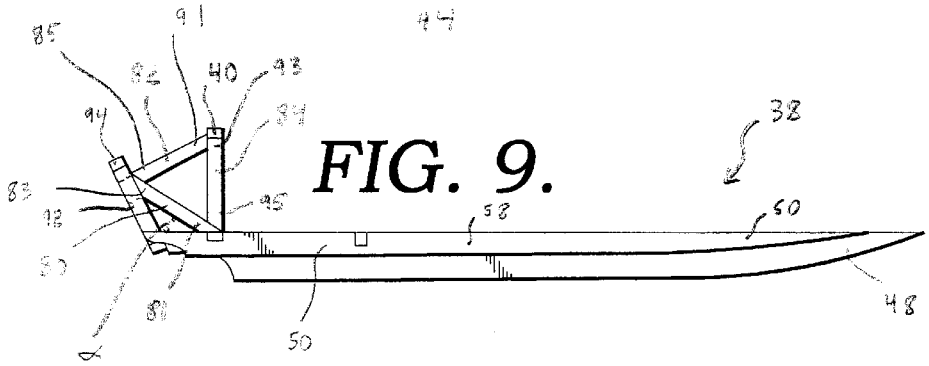
FIG. 9 is a side view of the internal framework of FIG. 8.

With reference to FIGS. 5 and 6, a stringer assembly 32, keel plate 33, and a fuel tank 34 are located below a deck 36 of the boat 10. With reference to FIGS. 8 and 9, the internal framework 38 of the boat is isolated and shown. The internal framework includes the aforementioned stringer assembly 32, a splash well beam 40 extending from port to starboard, a transom frame assembly 42, and a first knee brace assembly 44 and second knee brace assembly 46 tying the stringer assembly 32, splash well beam 40 and transom frame assembly 42 to one another.

The stringer assembly 32 has a main stringer 48 and a secondary stringer 50 on the starboard side of the boat and a main stringer 52 and secondary stringer 54 on the port side of the boat. Each of the stringers is made from an aluminum L-beam member with the upper surface of the beam directed outwardly from the center of the assembly.

The stringers are generally linear and run parallel with one another. Since the bow 56 of the boat 10 is somewhat rounded, the secondary stringers 50 and 54 terminate before main stringers 48 and 50. As shown in FIG. 9, the top members of the L-beam of the stringers form a generally flat surface upon which the deck 36 (FIGS. 5 and 6) of the boat may rest. The bottom of the stringers are shaped in accordance with the shape of a typical bass fishing boat bottom. Thus, the secondary stringers do not extend to the same depth of the main stringers located closer to the keel. Additionally, as illustrated by example secondary stringer 50 in FIG. 9, the stringer 50 has a body portion 58 with a generally planar bottom and an end portion 60 having an upwardly curved bottom as the stringer extends toward the bow.

Beginning at the bow, a stringer front platform beam 62 is secured to the secondary stringers 50 and 54, and extends laterally across main stringers 48 and 50 within notches 64 and 66 in the respective stringers. The stringer front platform is preferably formed from a tubular aluminum having a generally rectangular cross section. Near the center of main stringers 50 and 48, a fuel tank cover assembly 68 overlays the main stringers. The fuel tank cover assembly includes first and second members 70 and 72 overlaying the stringers 48 and 52 and a cross member 74 coupled between each of the members 70 and 72. When the stringer assembly 32 is in the boat, the generally rectangular fuel tank cover assembly 68 overlays the fuel tank 34 (FIG. 6).

On the stem side of the stringer assembly 30, a stringer livewell beam 76 and stringer knee brace beam 78 extend across each of the stringers 48, 50, 52 and 54 of the stringer assembly 32 and are received within notches and secured thereto. The stringer livewell beam 76 and stringer knee brace beam 78 are secured to the boat hull 10 at the ends of the beams extending beyond the secondary stringers.

The first knee brace assembly 44 includes a first diagonal beam 80, a first top beam 82 and a first vertical beam 84, each beam preferably formed of an extruded aluminum tube member having a generally rectangular cross section. The first end 81 of the first diagonal beam 80 is rigidly secured to the stringer knee brace beam 78 at the intersection of the stringer knee brace beam 78 and first main stringer 48. As best shown in FIG. 9, the end 81 is angled to lie flush with respect to the upper surface of stringer knee brace beam 78. Preferably, the first diagonal beam 78 extends at an angle $\alpha$ of about 43° with respect to the surface of the beam.

Figure 10:
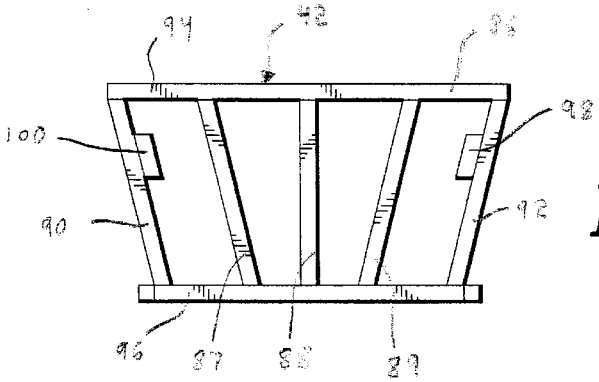
FIG. 10 is a front elevational view of the transom frame assembly of FIG. 8.

With reference to FIG. 10, the transom frame assembly 42 is shown. The transom frame assembly has a frame 86 and a number of braces 87, 88 and 89 formed within the frame 86. Each of the elements is also preferably made of aluminum. The frame 86 has opposing side members 90 and 92 and opposing top and bottom members 94 and 96. Knee brace boxes 98 and 100 are located on the interior of side members 90 and 92. Central brace 88 is disposed at the midpoint between the side members 90 and 92. The outer-braces 87 and 89 are directed slightly inwardly from the top member 94 to the bottom member 96. The second end 83 of first diagonal beam 80 is secured to transom frame assembly at knee brace box 98. The second end 83 presents an angled face for securing the diagonal beam to the knee brace box 98 (phantom lines in FIG. 9) so that the transom frame assembly 42 is held at an angle of about 22° from the normal line extending from the stringers. When properly positioned, bottom member 96 of the transom frame assembly 42 abuts the rear faces of main stringers 48 and 52 for additional support.

A first end 85 of first top beam 82 is secured to the first diagonal beam 80 at knee brace box 98. At the second end 91 of first top beam 82 is secured to the splash well beam 40. The angled face of second end 91 is welded to the beam 40 so that a portion of the second end 91 is below beam 40. A first end 93 of first vertical beam 84 is secured to the splash well beam 40 and second end 91 of first top beam 82, and a second end 95 is secured to the stringer knee brace beam 78. The first end 93 lies flush with the bottom of splashwell beam 40 and the portion of second end 91 of first top beam 82 is in contact with and secured to the surface of first vertical beam 84. The second end 95 is angled to lie flush against the surface of first diagonal beam 80 as shown in FIG. 9.

The second knee brace assembly 46 includes a second diagonal beam 102, a second top beam 104, and a second vertical beam 106 and is secured to side member 92 of frame 86 at the second knee brace box 102 in a manner similar to the first knee brace assembly 44.

By providing a knee brace assembly in accordance with the present invention, the highly stressed transom is supported by the stringer assembly in both the lateral and longitudinal directions. The support at the transom is of critical importance because of the stresses placed upon the transom due to the weight of the motor (not shown) and the high forces placed at the stem of the boat when operated at high speeds.

Figure 11:
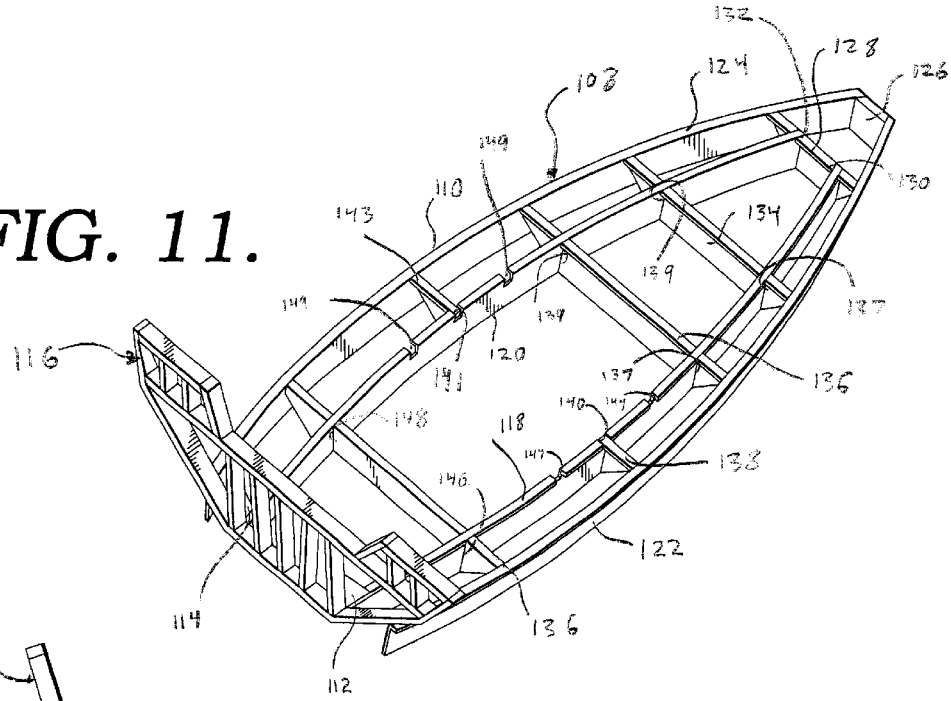
FIG. 11 is a perspective view of an alternative internal framework in accordance with the present invention.
Figure 12:
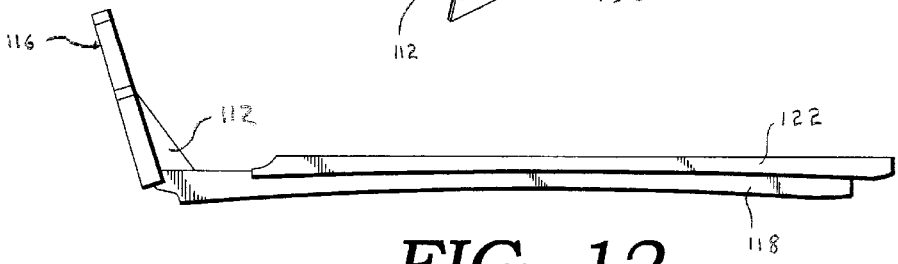
FIG. 12 is a side elevational view of the internal framework of FIG. 11.

With reference to FIGS. 11 and 12, an alternative internal frame work 108 is shown. The internal framework 108 is particularly effective in boats having deeper boat hulls than typical bass fishing boats. The framework 108 includes a stringer assembly 110, a pair of knee braces 112 and 114 and a transom frame assembly 116. The stringer assembly 110 includes a main starboard stringer 118, a main port stringer 120, a secondary starboard stringer 122 and a secondary port stringer 124. The stringers are also made from aluminum L-shaped members and the upstanding portion of each member is directed toward the outside of the boat. As shown in FIG. 12, the secondary stringer 122 has significantly less depth than main stringer 120 since the secondary stringer is supported by the tapered sidewalls of the boat and the main stringer rests on the bottom. More importantly, the stringers are outwardly curved with respect to the inner of the boat to generally mimic the curve of the hull sidewalls 14 and 16. This curved stringer design transfers the longitudinal load advantageously to prevent the boat from flexing or otherwise deforming.

At the bow end, the secondary stringers 122 and 124 are securely coupled together by a first lateral beam 126 preferably welded to the stringers. A second lateral beam 128 couples each of the curved stringers 118, 120, 122 and 124 to one another. Namely, slots 130 and 132 are formed within the second lateral beam 128 for receipt of the stringers. A third lateral beam 134 and fourth lateral beam 136 are rigidly secured to either of the secondary stringers 122 and 124 and placed through slots 137 within the main stringers 118 and slots 139 within main stringer 120. A pair of lateral short brackets 138 and 143 are located on the interior of the secondary stringers 122 and 124 near the midpoint and are placed within a notch 140 within the upper surface of main stringers 118 and a notch 141 with the upper surface of main stringer 120. A fifth lateral beam 144 is secured to either of the secondary stringers 122 and 124 and placed through slots 146 and 148 within main stringers 118 and 120, respectively.

Knee braces 112 and 114 are secured to and extend from main stringers 118 and 120 are secured to transom frame assembly 116 as is conventional in the art. The transom frame assembly may be in the shape as a chevron as indicated in FIG. 11 or any of a number of other conventional transom frame assembly shapes. Any of a number of additional lateral members may be utilized to secure the main stringers to the secondary curved stringers. For instance, an additional lateral member may be located between the knee braces 112, 114 and the fourth lateral member 136 to provide additional lateral support near the stem of the stringer assembly. Moreover, additional brackets may be placed within unused notches 147 in main starboard stringer 118 and notches 149 in main port stringer 124.

Figure 7:
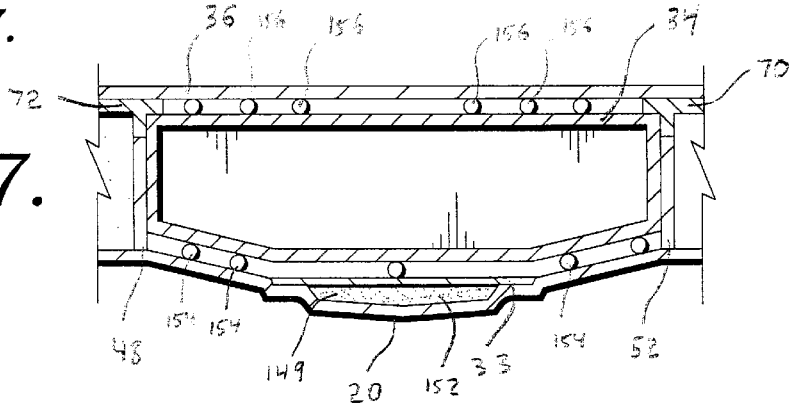
FIG. 7 is an enlarged view of the area designated by the numeral 7 in FIG. 6.

With reference back to FIGS. 5 and 6, the keel plate 33 of the present invention is located between the deck 36 and keel surface 26 of the boat bottom 18. The keel plate is preferably an aluminum plate having a width of about one foot. Specific reference to FIGS. 6 and 7, the keel plate 33 is located over the interior of keel surface 26 of boat hull 10. As shown in FIG. 7, the keel surface 26 has a bottom and a pair of upstanding sidewalls. Accordingly, when the keel plate 33 is secured to the sidewalls, the keel plate 33 and the interior of keel surface 26 define a longitudinal cavity 149 as shown in FIG. 5. The keel plate has a number of apertures 150 formed on the upper surface 152 of the plate. During construction of the boat, a high density foam material 152 is placed within the longitudinal cavity 149 defmed by the inside of keel surface 26 and keel plate 32. The foam material is placed within the cavity and the apertures are sealed so that the foam is held at a pressure of about 50 psi to form a stiffening column through the keel of the boat. A number of support tubes 154 shown schematically in FIG. 7, are placed over the keel plate 30 and bottom 18 to support the fuel tank 34. The fuel tank 34 is located lateral between the main stringers 48 and 52. A second layer of support tubes 156 overlays the tank 34 and the deck is secured on the upper surfaces of stringers 48, 50, 52 and 54 of stringer assembly 32 and the support tubes 156. As shown in FIG. 6, the cavities 158, 160, 162 and 164 formed between the boat bottom 18, the deck 36 and each of the stringers 50, 52, 54, and 56 are also filled with the high density foam material. Typically, the pressure at which the foam is placed within these cavities is less than the pressure achieved between the keel plate 132 and the keel surface 26.

Figure 13:
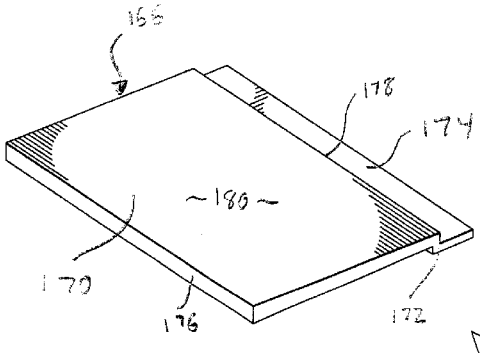
FIG. 13 is a perspective view of the integral trim tab of FIG. 3.

With reference to FIG. 13, an integral trim tab 168 is shown. The tab 168 has a first base member 170, a bend 172 and a flange 174. The lead edge 176 of base member 170 is wider than the rear edge 178. In a preferred embodiment, the width of ledge edge 176 is ⅜ of an inch and the rear edge 178 has a width of about ⅛ of an inch. The bend 172 extends generally normally from the bottom of base member 170 and the flange 174 extends from the bend 172 at an angle 0 with respect to the top surface 180 at base member 170. The aluminum tab 168 may be formed by a bending sheet metal or by an extrusion process.

Figure 14:
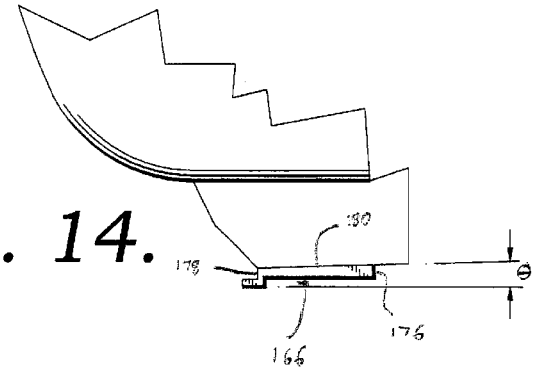
FIG. 14 is an enlarged view of the area designated by the numeral 14 in FIG. 1.

With reference to FIGS. 1, 3, and 14, the integral trim tab 168 is secured to the boat at the starboard edge of the boat bottom 18 so that the upper surface 180 of base member 170 is flush with planar portion at bottom and bend 172 extends downwardly with respect to the stern. Preferably, the tab is welded to the boat. The angle θ of the flange 174 with respect to the top surface 180, and the generally planar portion of the bottom of the boat to which the top surface is attached, is between approximately 1–10°. This angle, known as the shingle angle, is critical to the performance of the boat since a great deal of the pressure is exerted to boat hull 10 is at the last 10–12 inches of the boat proximate at the stem.

A second integral trim tab 176 is welded to the port side of the boat as shown in FIG. 3. By use of the tabs of the present invention, the shingle is precisely and accurately defined and the performance of the boat is greatly enhanced. Specifically, the shingle angle can be accurately controlled during manufacturing and maintained in use to direct the water about the boat hull.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A boat having a stem, bow, port, starboard and keel, said boat comprising:

a first beam extending laterally from port to starboard;

a stringer assembly, said stringer assembly having a plurality of longitudinal members and a stringer knee brace beam, said stringer knee brace beam extends laterally from port to starboard and is located between said first beam and the keel;

a transom frame assembly having opposing sides; and a first knee brace assembly having a diagonal beam, a top beam and a vertical beam, said diagonal beam is coupled between said stringer knee brace beam and said transom frame assembly, said top beam is coupled between said first beam and said diagonal beam proximate said transom frame assembly, and said vertical beam is coupled between said first beam proximate said top beam and said stringer knee brace beam proximate said diagonal beam.

2. The boat of claim 1 wherein said diagonal beam, said top beam and said vertical beam are substantially coplanar with one another.

3. The boat of claim 2 wherein said diagonal beam, said top beam and said vertical beam are made of metal tubing having a generally rectangular cross section.

4. The boat of claim 2 wherein said longitudinal members of said stringer assembly include a starboard main stringer and a port main stringer, wherein said stringer knee brace beam is coupled with said starboard main stringer and said port main stringer.

5. The boat of claim 4 wherein said diagonal beam and said vertical beam are coupled with said stringer knee brace proximate said starboard main stringer.

6. The boat of claim 1 wherein said first knee brace assembly is secured to said vertical beam and said transom frame on the starboard side of the boat; and wherein the boat further comprises a second knee brace assembly secured to said vertical beam and said transom frame on the port side of the boat.

7. The boat of claim 6 wherein said longitudinal members of said stringer assembly include a main starboard stringer and a main port stringer, wherein said stringer knee brace beam is coupled with said starboard main stringer and said port main stringer.

8. The boat of claim 7 wherein said diagonal beam of said first knee brace assembly and said vertical beam of said first knee brace assembly are coupled with said stringer knee brace proximate said starboard main stringer.

9. The boat of claim 7 wherein said longitudinal members of said stringer assembly further comprise a secondary starboard stringer and a secondary port stringer, wherein said stringer knee brace beam is coupled with said secondary starboard stringer and said secondary port stringer.

10. The boat of claim 9 wherein said stringer assembly further comprises a plurality of lateral members.

11. A boat having a stem, bow, port, starboard and keel, said boat comprising:

a hull having a keel surface, said keel surface having a bottom and a pair of opposing sidewalls;

a keel plate coupled between said sidewalls to define a cavity between said keel surface and said keel plate; and a foam material is placed within said cavity to provide support to said hull.

12. The boat of claim 11 wherein said keel plate comprises a plurality of apertures wherein foam is placed within said cavity through said apertures.

13. The boat of claim 11 further comprising a stringer assembly, said stringer assembly having a plurality of members extending from said hull, and wherein said boat further comprises a deck disposed on said members of said stringer assembly opposite said hull wherein a plurality of compartments are defined between said hull and said deck between said stringers.

14. The boat of claim 11 further comprising a second foam material located within said compartments.

15. A boat having a bow and stern, said boat comprising:

a hull having an outwardly curved starboard sidewall and outwardly curved port sidewall; and a stringer assembly having a plurality of lateral members and a plurality of curved stringers, said curved stringers having a shape generally corresponding to the curvature of said starboard and port sidewalls and including a main starboard stringer, a main port stringer, a secondary port stringer and a secondary starboard stringer, wherein said main stringers and said secondary stringers are coupled with one another by said lateral members, and wherein said main stringers include a notched area, said notched area receiving at least one of said lateral members.

16. A boat having a bow and stem, said boat comprising:

a hull having an outwardly curved starboard sidewall and outwardly curved port sidewall;

a stringer assembly having a plurality of lateral members and a plurality of curved stringers, said curved stringers having a shape generally corresponding to the curvature of said starboard and port sidewalls and including a main starboard stringer, a main port stringer, a secondary port stringer and a secondary starboard stringer, wherein said main stringers and said secondary stringers are coupled with one another by said lateral members; and a transom frame assembly, said transom frame assembly coupled with said main port stringer and said main starboard stringer.

17. A boat having a stem, said boat comprising:

a bottom, said bottom having opposing sides, each side having a generally planar section proximate the stem; and a first integral trim tab, said first trim tab having a base member, a bend and a flange, said base member having a lead edge, a rear edge and a top surface, wherein said bend extends generally normally from said rear edge of said base members and said flange extends from said bend at a predetermined angle between about 1° and about 10° with respect to said generally planar section of said bottom when said top surface of said base member is secured to one of said sides of said bottom.

18. The boat of claim 17 wherein lead edge of said base member is wider than said rear edge.

19. The boat of claim 17 wherein said flange is generally planar.

20. The boat of claim 19 wherein the distance between said rear edge and said trail edge is substantially greater than the length of said flange.

21. The boat of claim 20 having a second integral trim tab, said second integral trim tab coupled with said other of said sides of said bottom.

* * * * *